US006872043B2

(12) United States Patent
Yukawa et al.

(10) Patent No.: US 6,872,043 B2
(45) Date of Patent: Mar. 29, 2005

(54) SWIVEL TYPE WORKING VEHICLE

(75) Inventors: Katsuhiko Yukawa, Izumi (JP); Junichi Fujiwara, Osaka (JP)

(73) Assignee: Kubota Corporation, Osaka (JP)

( * ) Notice: Subject to any disclaimer, the term of this patent is extended or adjusted under 35 U.S.C. 154(b) by 43 days.

(21) Appl. No.: 10/229,957

(22) Filed: Aug. 28, 2002

(65) Prior Publication Data

US 2003/0210972 A1 Nov. 13, 2003

(30) Foreign Application Priority Data

May 9, 2002 (JP) ..... 2002-134667

(51) Int. Cl.[7] ..... E02F 9/00
(52) U.S. Cl. ..... 414/694; 414/918
(58) Field of Search ..... 414/680, 694, 414/722, 723, 918

(56) References Cited

U.S. PATENT DOCUMENTS

| | | | | |
|---|---|---|---|---|
| 4,193,734 A | * | 3/1980 | Williams | 414/918 X |
| 5,108,253 A | * | 4/1992 | Kobayashi et al. | 414/918 X |
| 5,176,491 A | * | 1/1993 | Houkom | 414/918 X |
| 5,806,313 A | | 9/1998 | Koshi et al. | |

FOREIGN PATENT DOCUMENTS

| | | |
|---|---|---|
| DE | 299 20 652 U1 | 2/2000 |
| EP | 1 124 017 A1 | 8/2001 |
| JP | 4-2166722 | 8/1992 |
| JP | 8-134948 | 5/1996 |
| JP | 09021145 | 1/1997 |
| JP | 10231534 | 9/1998 |
| JP | 11107310 | 4/1999 |
| JP | 2000273904 | 10/2000 |
| JP | 2000314149 | 11/2000 |

OTHER PUBLICATIONS

Die alten Rahmen gesprengt, DE–Z << bpz >>, Nr. 10/98, Seiten 48, 51, 52.

* cited by examiner

*Primary Examiner*—Donald W. Underwood
(74) *Attorney, Agent, or Firm*—Webb Ziesenheim Logsdon Orkin & Hanson P.C.

(57) ABSTRACT

A swivel type working vehicle includes a running device (30), a swivel base (32) mounted on the running device to be swivelable about a vertical swivel axis (31), a swing bracket (5) supported to be swingable about a vertical axis by a flange unit (4) disposed at a front end of the swivel base, a boom (2) having a proximal end (2B) thereof attached to the swing bracket to be swingable about a horizontal axis (6), a boom cylinder (3) having one end thereof connected to the swing bracket and the other end to the boom for swinging the boom, a hydraulic pressure takeoff device (10) disposed in a distal end region (2C) of the boom, and hydraulic pressure takeoff pipes (12A, 12B) for supplying hydraulic pressure to the hydraulic pressure takeoff device (10). The boom (2) is a hollow box having a front wall (17), a left wall (16A), a right wall (16B) and a rear wall (14) extending longitudinally of the boom. The boom cylinder (3) is disposed outside the boom to extend along the rear wall of the boom. The hydraulic pressure takeoff pipes (12A, 12B) extend from the swivel base through a proximal opening (15) formed adjacent the proximal end (2B) into the boom to reach the hydraulic pressure takeoff device.

10 Claims, 5 Drawing Sheets

SWIVEL TYPE WORKING VEHICLE

BACKGROUND OF THE INVENTION

1. Field of the Invention

This invention relates to a swivel type working vehicle, such as a backhoe, having a swivel base mounted on a running device to be swivelable about a vertical swivel axis, a swing bracket pivotally supported to be swingable about a vertical axis by a flange unit disposed at the front end of the swivel base, a boom attached at a proximal end thereof to the swing bracket to be swingable about a horizontal axis, a boom cylinder connected at one end thereof to the swing bracket and at the other end to the boom for swinging the boom, a hydraulic pressure takeoff device disposed at a distal end of the boom, and hydraulic pipes for supplying hydraulic pressure to the hydraulic pressure takeout device.

2. Description of the Related Art

A swivel type working vehicle such as a backhoe may optionally be equipped with an auxiliary working implement such as a breaker or auger in place of a main working implement such as a bucket. A hydraulic pressure takeoff device is provided to supply hydraulic pressure to the hydraulic equipment belonging to the auxiliary implement. A hydraulic pressure takeoff hose or the like is connected to a hydraulic pressure takeoff port of the hydraulic pressure takeoff device. Hydraulic pressure is supplied to the hydraulic equipment of the auxiliary implement through the hydraulic pressure takeoff hose. In one example of conventional swivel type working vehicle, the hydraulic pressure takeoff device is disposed on the boom. In this example, hydraulic pipes extend from the swivel base having a hydraulic pump and the like, along an outer side wall of the boom to the hydraulic pressure takeoff device, for supplying hydraulic pressure from the hydraulic pump to the hydraulic pressure takeoff device. Since the hydraulic pipes extend along the outer side wall of the boom, care must be taken to keep the hydraulic pipes out of contact with other objects during operation. This has been a cause of seriously lowering the working efficiency of the swivel type working vehicle.

In Japanese Patent Publication (Unexamined) 1996-134948, a boom has a channel-shaped lower half thereof opening rearward. Part of a boom cylinder extends through the rear opening into an internal space of the boom. One end of the boom cylinder is connected to a pivot shaft disposed in the internal space, and the other end connected to a swing bracket. This swivel type working vehicle has hydraulic pipes connected to the boom cylinder and contained in the internal space of the boom. In this construction, though hydraulic pipes for each cylinder are mounted inside the boom, the rigidity of the boom is not satisfactory since part of the boom has a sectional profile opening rearward (i.e. channel-shaped sectional profile) to receive at least part of the boom cylinder in the internal space of the boom.

SUMMARY OF THE INVENTION

The object of this invention is to provide a swivel type working vehicle having a boom of box-shaped sectional profile with a substantially entire rear region thereof closed by a rear wall to have increased rigidity, and hydraulic pipes received in an internal space of the boom through an opening formed in a proximal end region of the rear wall whereby the boom may be actuated during operation without taking care to keep the hydraulic pipes out of contact with other objects.

The above object is fulfilled, according to this invention, by a swivel type working vehicle comprising a running device, a swivel base mounted on the running device to be swivelable about a vertical swivel axis, a swing bracket supported to be swingable about a vertical axis by a flange unit disposed at a front end of the swivel base, a boom having a proximal end thereof attached to the swing bracket to be swingable about a horizontal axis, a boom cylinder having one end thereof connected to the swing bracket and the other end to the boom for swinging the boom, a hydraulic pressure takeoff device disposed in a distal end region of the boom, and hydraulic pressure takeoff pipes for supplying hydraulic pressure to the hydraulic pressure takeoff device, wherein the boom is a hollow box having a front wall, a left wall, a right wall and a rear wall extending longitudinally of the boom, the boom cylinder is disposed outside the boom to extend along the rear wall of the boom, and the hydraulic pressure takeoff pipes extend from the swivel base through a proximal opening formed adjacent the proximal end into the boom to reach the hydraulic pressure takeoff device.

In this construction, the boom has a box structure with a rear plane thereof closed by the rear wall. Thus, in spite of the narrowness, the boom has sufficient rigidity. Further, the hydraulic pipes for supplying hydraulic pressure to the hydraulic pressure takeoff device disposed in the distal end region of the boom extend through the proximal opening into the internal space of the boom. These hydraulic pipes never sag outside the walls of the boom. The operator may control the boom during operation without taking care to keep the hydraulic pipes out of contact with other objects.

Where this swivel type working vehicle is a backhoe, for example, a bucket cylinder is constantly provided as a component thereof for swinging a bucket. The bucket cylinder may be connected to hydraulic pipes extending from the swivel base through the proximal opening formed adjacent the proximal end into the boom. This construction avoids the inconvenience of the hydraulic pipes extending outside the boom.

In one preferred embodiment of this invention, the hydraulic pressure takeoff device has hydraulic pressure takeoff ports extending through the left wall and the right wall, respectively. With this construction, hydraulic pressure takeoff hoses are arranged on the side walls of the boom for supplying hydraulic pressure to a hydraulic device of an auxiliary working implement such as a breaker or auger. The hydraulic pressure takeoff hoses, even if elongated, can smoothly follow movement of the auxiliary working implement. Where the two hydraulic pressure takeoff hoses are connected to the hydraulic pressure takeoff ports, the two hoses never become entwined with each other.

In another preferred embodiment of this invention, the hydraulic pressure takeoff device is mounted in the boom to form a space with the front wall, the space receiving the hydraulic pipes extending to the bucket cylinder. With this construction, the hydraulic pressure takeoff device allows the hydraulic pipes connected to the bucket cylinder for driving the bucket to extend through the space between the hydraulic pressure takeoff device and the front wall, and smoothly to extend out of the distal end of the boom to the bucket cylinder. This construction reliably avoids interference between the bucket cylinder hydraulic pipes and hydraulic pressure takeoff device.

In a further preferred embodiment of this invention, the rear wall defines an opening for allowing access the hydraulic pressure takeoff device, the opening being closable by a lid. This access opening allows the hydraulic pressure takeoff device to be assembled to the boom with ease. The access opening also facilitates maintenance of the hydraulic pressure takeoff device. In addition, since this opening may be dosed by the lid, the hydraulic pressure takeoff device is protected from soil, sand, waste water, dust and so on during operation.

In a further preferred embodiment of this invention, the swing bracket defines a hydraulic pipe receiving bore communicating with the proximal opening, the hydraulic pipes extending from the swivel base into the boom through the hydraulic pipe receiving bore and the proximal opening. With this construction, the hydraulic pipes may extend a minimum distance from the swivel base through the hydraulic pipe receiving bore to the proximal opening. The hydraulic pipes are little exposed outwardly also adjacent the swing bracket, to be prevented from contacting other objects during operation of the swivel type working vehicle.

In a further preferred embodiment of this invention, the swing bracket is disposed above the running device, the vertical swing axis being disposed rearwardly of a front roller axis of front rollers of crawlers constituting the running device. A very small backhoe is required to have a minimal body length while maintaining excellent weight balance. When the backhoe is in normal posture (with the boom facing straight forward; see FIG. 1), the swing bracket may lie in a space defined by upper surfaces of the crawlers and the front end surface of the swivel base disposed above the crawlers, with the swing axis of the swing bracket disposed rearwardly of the front roller axis. This arrangement allows the very small backhoe to perform a bucket operation in a stable way.

Other features and advantages of this invention will be apparent from the following description of an embodiment to be taken with reference to the drawings.

DESCRIPTION OF THE PREFERRED EMBODIMENTS

An embodiment of this invention will be described hereinafter with reference to the drawings.

FIGS. 1 through 5 show a swivel type working vehicle, and particularly a hydraulic piping layout thereof, according to this invention.

Figure 1:
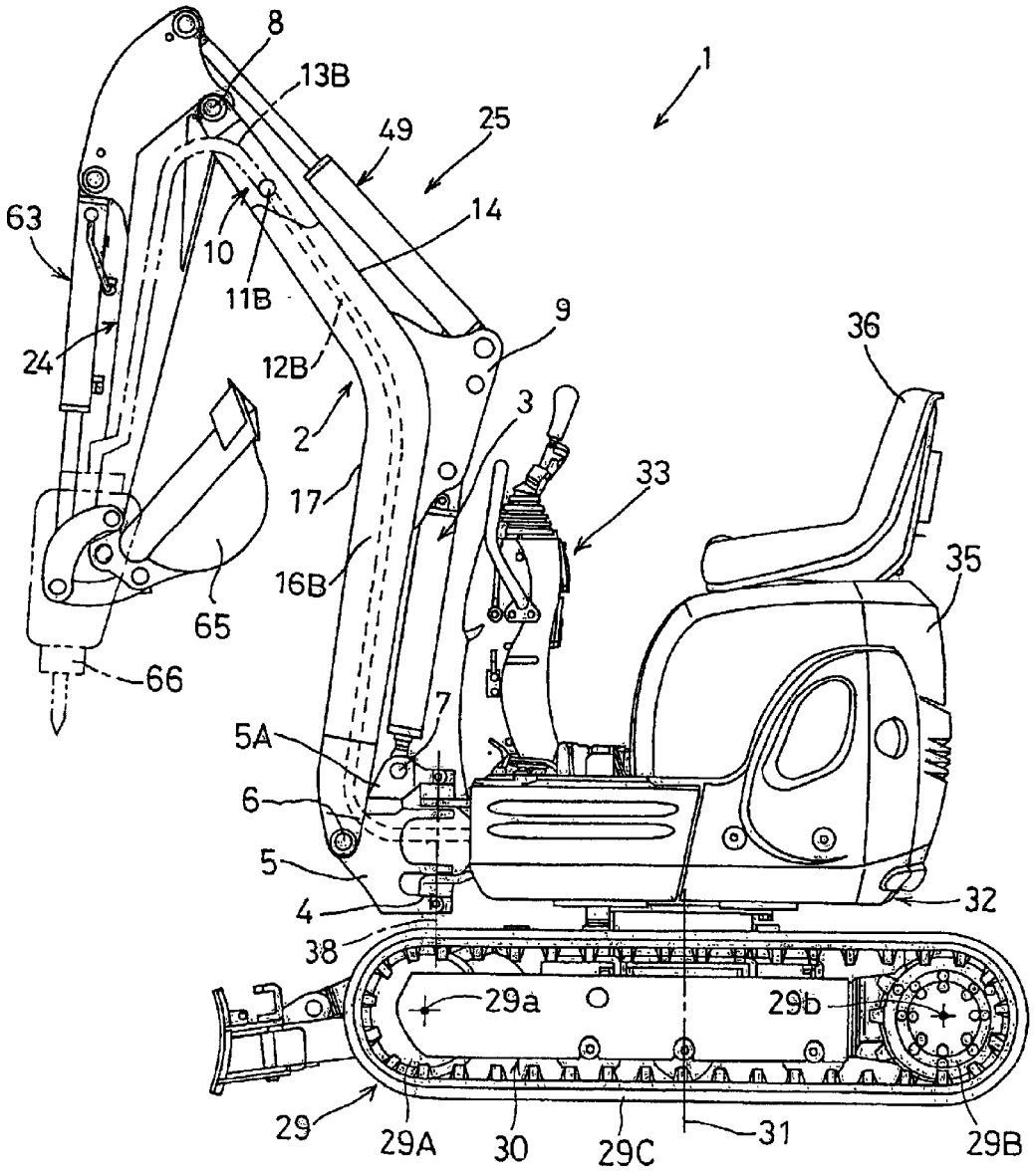
FIG. 1 is a side elevation of a backhoe which is one example of working vehicles according to this invention.

FIG. 1 shows a backhoe exemplifying a swivel type working vehicle 1. The working vehicle 1 has right and left crawlers 29 constituting a running device 30 supporting a swivel base 32 to be swivelable about a vertical swivel axis 31. The swivel base 32 has an excavating assembly 25 disposed at the front thereof and including a boom 2.

Each crawler 29 includes a front roller 29A rotatable about an axis 29*a*, a rear roller 29B rotatable about an axis 29*b*, and a crawler belt 29C wound around these rollers.

The swivel base 32 has an engine, a fuel tank and an oil tank (not shown) mounted on a rear portion thereof and enclosed in a cover 35. A driver's seat 36 is disposed above the cover 35. A control box 33 is disposed on a front portion of the swivel base 32 forwardly of the driver's seat 36. The control box 33 contains substantially all components necessary for controlling the backhoe. The backhoe shown in FIG. 1 has no sunshade covering the driver's seat and so on, but a sunshade may be provided.

Figure 2:
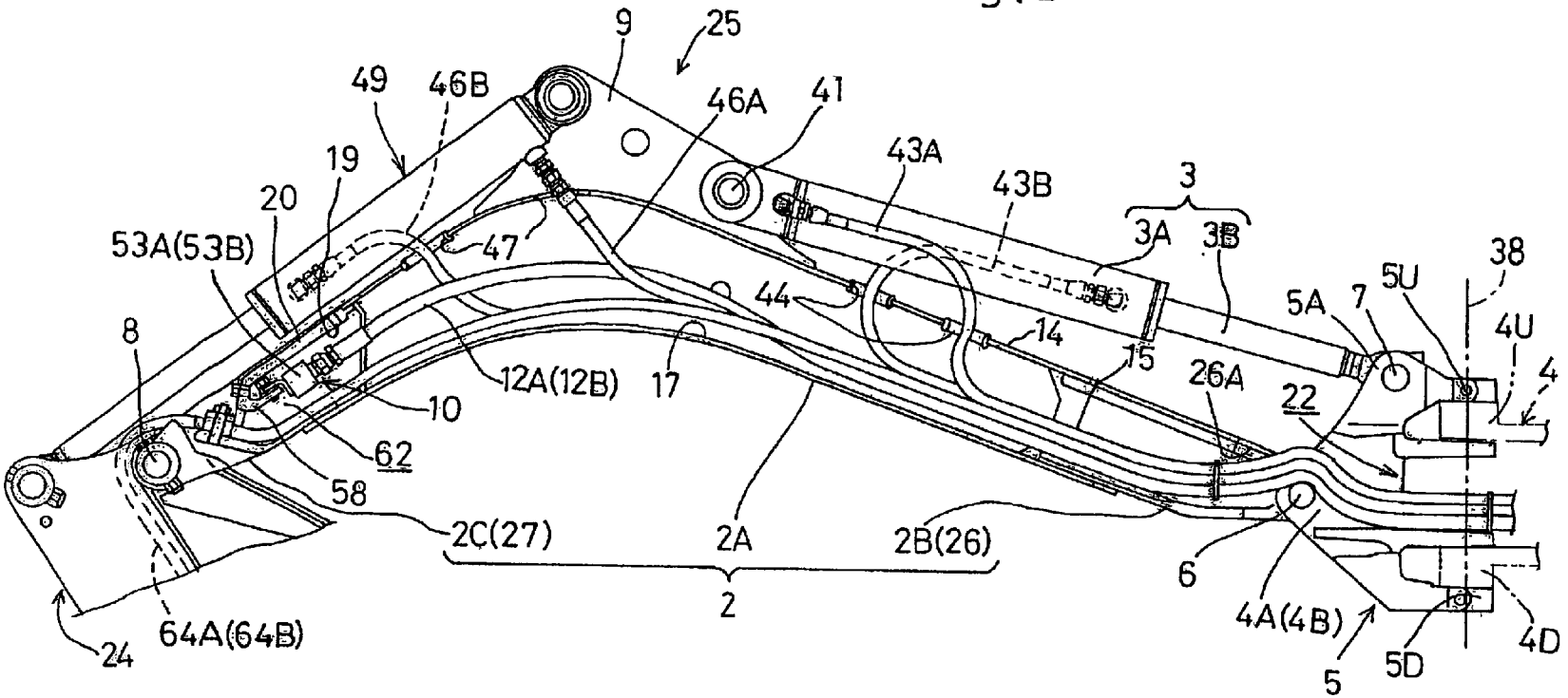
FIG. 2 is a sectional side view of a boom of the backhoe shown in FIG. 1.
Figure 5:
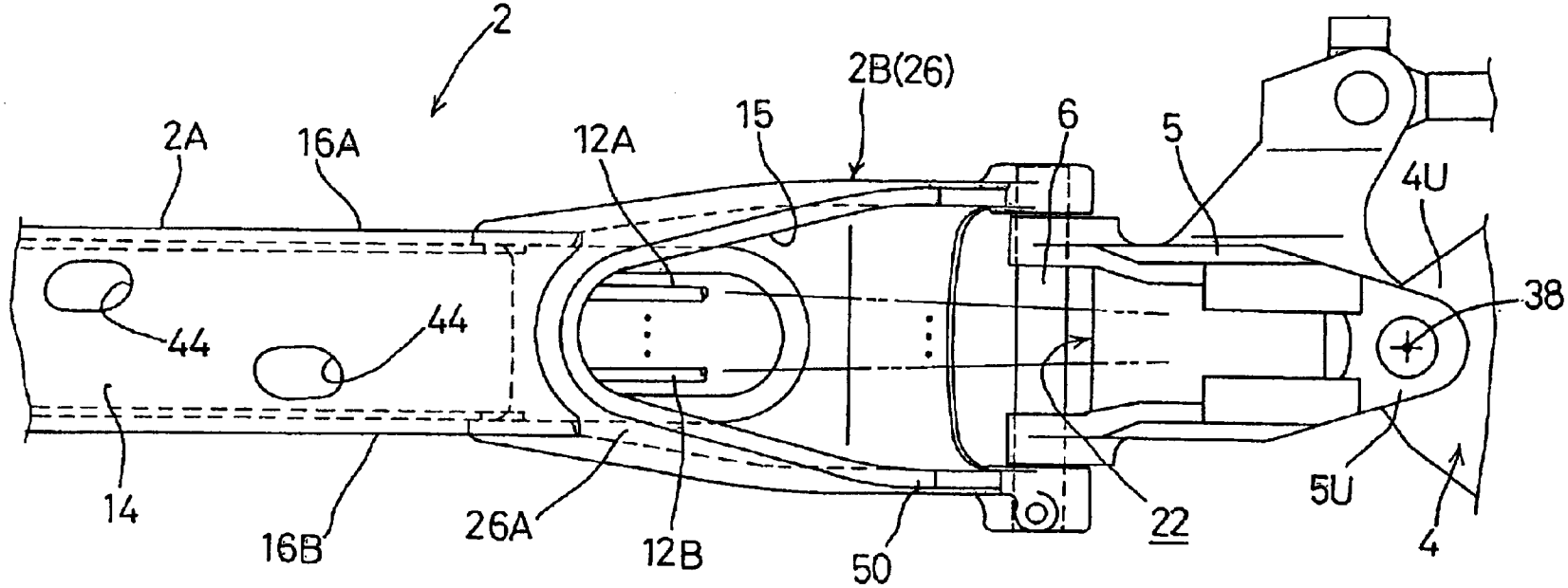
FIG. 5 is a plan view of a proximal portion of the boom of the backhoe shown in FIG. 1.

As shown in FIGS. 1, 2 and 5, the swivel base 32 has a flange unit 4 disposed at the front thereof. The flange unit 4 has an upper flange 4U and a lower flange 4D projecting forward and vertically spaced apart from each other. The upper and lower flanges 4U and 4D define coaxial bores for receiving a pivot shaft having a vertical axis 38.

The excavating assembly 25 includes a swing bracket 5 supported by the flange unit 4 to be swingable about the vertical axis 38, the boom 2 having a proximal end 2B pivotally supported by the swing bracket 5, an arm 24 pivotally supported by a distal end 2C of the boom 2 to be swingable about a horizontal axis 8, and a bucket 65 pivotally supported by a distal end of the arm 24 to be swingable about a horizontal axis.

As seen from FIG. 1, the swing bracket 5 is disposed above the running device 30, and its swing axis 38 is disposed rearwardly of the front roller axis 29*a* of the crawlers constituting the running device.

The swing bracket 5 has upper and lower supports 5U and 5D engaged with the upper and lower flanges 4U and 4D of the flange unit 4. Thus, the swing bracket 5 is connected to the flange unit 4 to be swingable right and left.

The swing bracket 5 has a penetration space defined between the upper and lower supports unit 5U and 5D and surrounded by right and left side walls 4A and 4B and the upper and lower supports 5U and 5D of swing bracket 5. This penetration space functions as a hydraulic pipe receiving bore 22 to be described hereinafter.

The proximal end 2B of the boom 2 is pivotally supported by the swing bracket 5 through a horizontal shaft 6. The swing bracket 5 has a cylinder support 5A projecting upward like a cockscomb. A boom cylinder 3, which is a hydraulic cylinder, has a rod 3B connected to the cylinder support 5A through a horizontal shaft 7.

The boom 2 includes a main body 2A thereof having a box structure formed of a channel structure of C-shaped section made of steel plate, with a band plate welded to an opening end of the channel structure. Thus, the main body 2A has a hollow box-like section. That is, the boom 2 is a hollow box having a front wall 17, a left side wall 16A, a right side wall 16B and a rear wall 14 extending longitudinally of the boom 2.

The main body 2A has, inserted into and fixed to opposite ends thereof, a proximal end member 26 acting as the proximal end 2B of the boom 2, and a distal end member 27 acting as the distal end 2C of the boom 2. The proximal end member 26 and distal end member 27 are castings, forgings or steel plate products The main boom body 2A is bent at a middle position thereof. A cylinder bracket 9 is secured outside the rear surface of the bent portion. The cylinder bracket 9 pivotally supports the end of a bottom 3A of boom cylinder 3 to be pivotable about a horizontal axis to swing the boom 2 vertically.

Thus, the boom cylinder 3 extends longitudinally of the boom 2 outside the rear surface of the boom 2. The boom 2 has a structure with the rear surface substantially closed by the rear wall 14. The boom 2 is highly rigid since its rear surface has no large opening.

In addition, the rear wall 14 of boom 2 defines a proximal opening 15 adjacent the proximal end 2B, through which the boom 2 receives hydraulic pipes 12A and 12B connected to a hydraulic pressure takeoff device 10 described hereinafter, and boom cylinder hydraulic pipes 43A and 43B for supplying hydraulic pressure to the boom cylinder 3.

More particularly, the proximal opening 15 is in the form of an elliptical opening formed in an upper wall 26A of the proximal end member 26 and elongated along the boom 2. The proximal opening 15 has a size necessary and sufficient for passing the hydraulic pipes 12A and 12B and so on, and does not have a large diameter. Thus, the proximal opening 15 hardly affects the rigidity of the boom 2.

The proximal end member 26 is made by casting or the like as noted hereinbefore, and the proximal opening 15 is not formed by a boring operation or the like. Thus, the rigidity of the proximal end member 26 is not lowered by the proximal opening 15. In addition, rigidity may be increased by increasing the wall thickness of portions surrounding the proximal opening 15. As shown in FIG. 5, the proximal opening 15 is reinforced by welding an edging plate 50.

The rear wall 14 below the boom cylinder 3 defines two elliptical receiving bores 44 elongated along the boom 2 to receive the hydraulic pipes 43A and 43B for supplying hydraulic pressure to the boom cylinder 3. Since the receiving bores 44 are elongated along the boom 2, the rigidity against a bending moment applied to the boom 2 may be maintained.

The distal end 2C of the boom 2 has a hydraulic pressure takeoff device 10 mounted therein for supplying hydraulic pressure to an auxiliary working implement such as a breaker 66 or auger. The hydraulic pressure takeoff device 10 has hydraulic pressure takeoff ports (service ports) arranged in the right and left side walls 16A and 16B of the boom 2 to be directed outward.

Further, the arm 24 is pivotally attached to the distal end 2C of the boom 2 to be swingable about the horizontal axis 8. The bucket 65, which is a main working implement, is detachable attached to the distal end of the arm 24 through links or the like. The arm 24 is vertically swingable by an arm cylinder 49 which is a hydraulic cylinder. The bucket 65 is operable by a bucket cylinder 63 which is a hydraulic cylinder, to engage in a scooping and dumping operation.

The arm cylinder 49 is supported at an end of a bottom 49A thereof by the cylinder bracket 9 to be pivotable about a horizontal axis. The arm cylinder 49 extends longitudinally of the boom 2 outside the rear surface of a forward portion of the boom 2.

The main working implement such as the bucket 65 attached to the arm 24 may be replaced by the auxiliary working implement such as the breaker 66. In this case, the auxiliary working implement is driven by hydraulic pressure taken out of the hydraulic pressure takeoff ports 11A and 11B through hydraulic pressure takeoff hoses 13A and 13B.

The boom rear wall 14 below the arm cylinder 49 defines two receiving bores 47 for receiving arm cylinder hydraulic pipes 46A and 46B to produce functions and effects similar to the case of the boom cylinder 3.

In this embodiment, the position of the boom 2 shown in FIG. 1 with the rear surface of the boom 2 extending substantially parallel to the boom cylinder 3 is a position where the boom 2 is erected and folded up to a limit. The control box 33 is disposed as forwardly on the swivel base 32 as possible, but not contacting the boom cylinder 3 in this state. The flange unit 4 projects only a small amount from the swivel base 32, so that the front surface of the control box 33 lies dose in the fore and aft direction to the upper and lower supports 5U and 5D of the swing bracket 5.

As a result, a necessary accommodation and walkthrough space is secured, and a good fore and aft balance of the swivel base 32 is maintained. A sufficient swing angle may be set for the boom 2 while bringing the boom 2 and boom cylinder 3 as dose to the front of the control box 33 as possible. The above noted construction realizes compactness of the swivel base 32 also.

Next, the hydraulic pressure takeoff device 10 and a layout of hydraulic pipes 12A and 12B connected to the hydraulic pressure takeoff device 10 will be described.

As shown in FIGS. 2 through 5, the hydraulic pressure takeoff device 10 is mounted in the distal end member 27 acting as the boom distal end 2C, and rearwardly of the horizontal support axis 8 of the arm 24. The hydraulic pressure takeoff device 10 has L-shaped connecting pipes 53A and 53B. These L-shaped connecting pipes 53A and 53B are arranged as spaced from an inner surface of a front wall 27D of the distal end member 27. Specifically, the L-shaped connecting pipes 53A and 53B are fixed by fasteners such as bolts or screws, through L-shaped metal fittings 59A and 59B to a supporting wall 58 projecting substantially horizontally and rearwardly in the boom 2 from a substantially middle position of a partition wall 57 rising from the front wall 27D. As a result, the hydraulic pressure takeoff device 10 defines a space 62 below and with the inner surface of the front wall 27D.

The L-shaped connecting pipes 53A and 53B have connecting openings directed toward the boom proximal end, to which the hydraulic pipes 12A and 12B are screw-connected.

The other openings of L-shaped connecting pipes 53A and 53B are opposed to the right and left side walls 27A and 27B of the distal end member 27 (i.e. the right and left side walls 16A and 16B of the boom 2), and are connected to hydraulic couplers 54A and 54B arranged in vertically intermediate positions of the right and left side walls 27A and 27B and having outer ends thereof acting as female connectors. The female ends of the hydraulic couplers 54A and 54B define the hydraulic pressure takeoff ports 11A and 11B.

The hydraulic pressure takeoff hoses 13A and 13B are connected to the hydraulic pressure takeoff ports 11A and 11B. Specifically, the hydraulic pressure takeoff hoses 13A and 13B are screw-connected to end openings of L-shaped connecting pipes 68A and 68B. The other end openings of the L-shaped connecting pipes 68A and 68B act as male type hydraulic couplers 55A and 55B fitted in the hydraulic pressure takeoff ports 11A and 11B.

With the hydraulic couplers 55A and 55B fitted in the hydraulic pressure takeoff ports 11A and 11B (i.e. female type hydraulic coupler 54A and 54B), pressure oil flows into and out of the hydraulic pressure takeoff hoses 13A and 13B.

Figure 3:
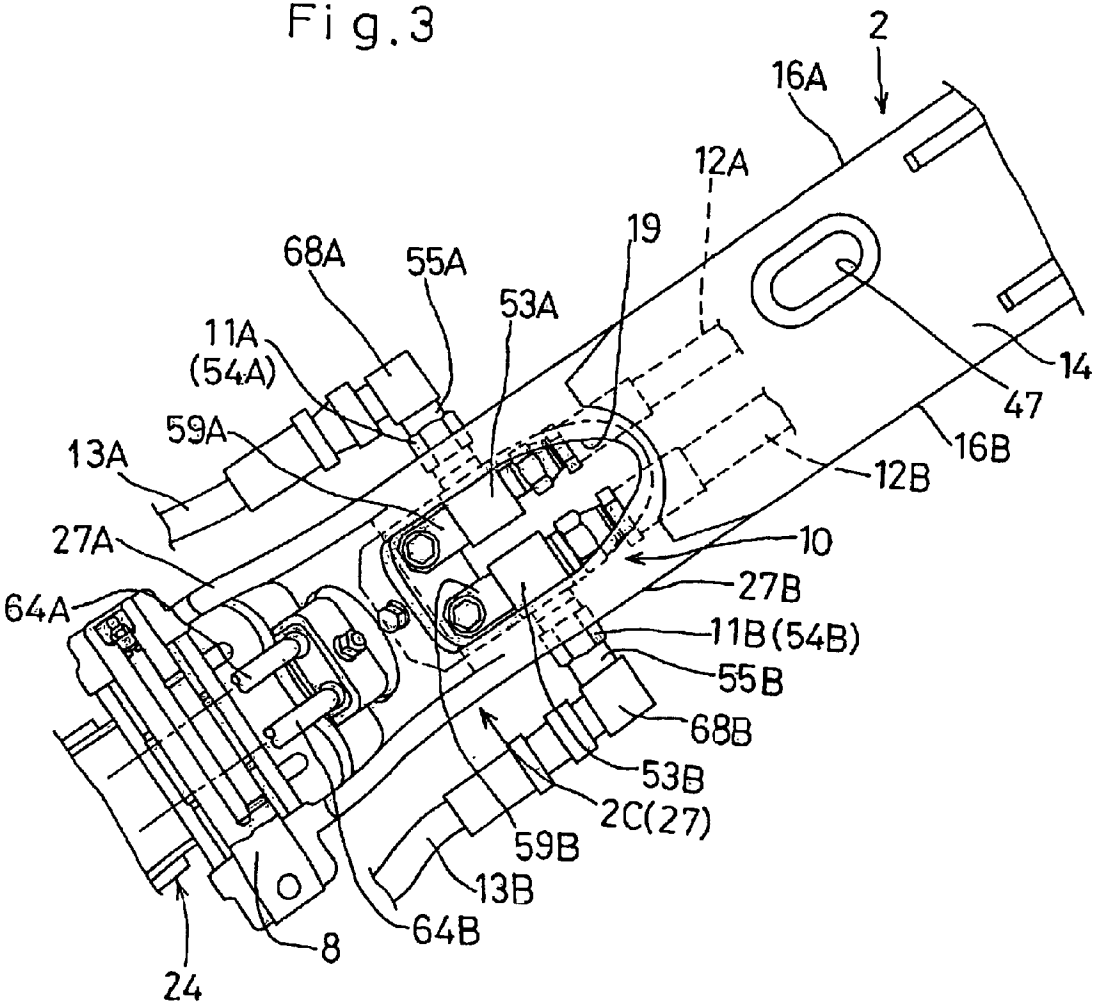
FIG. 3 is a plan view of a distal portion of the boom of the backhoe shown in FIG. 1.
Figure 4:
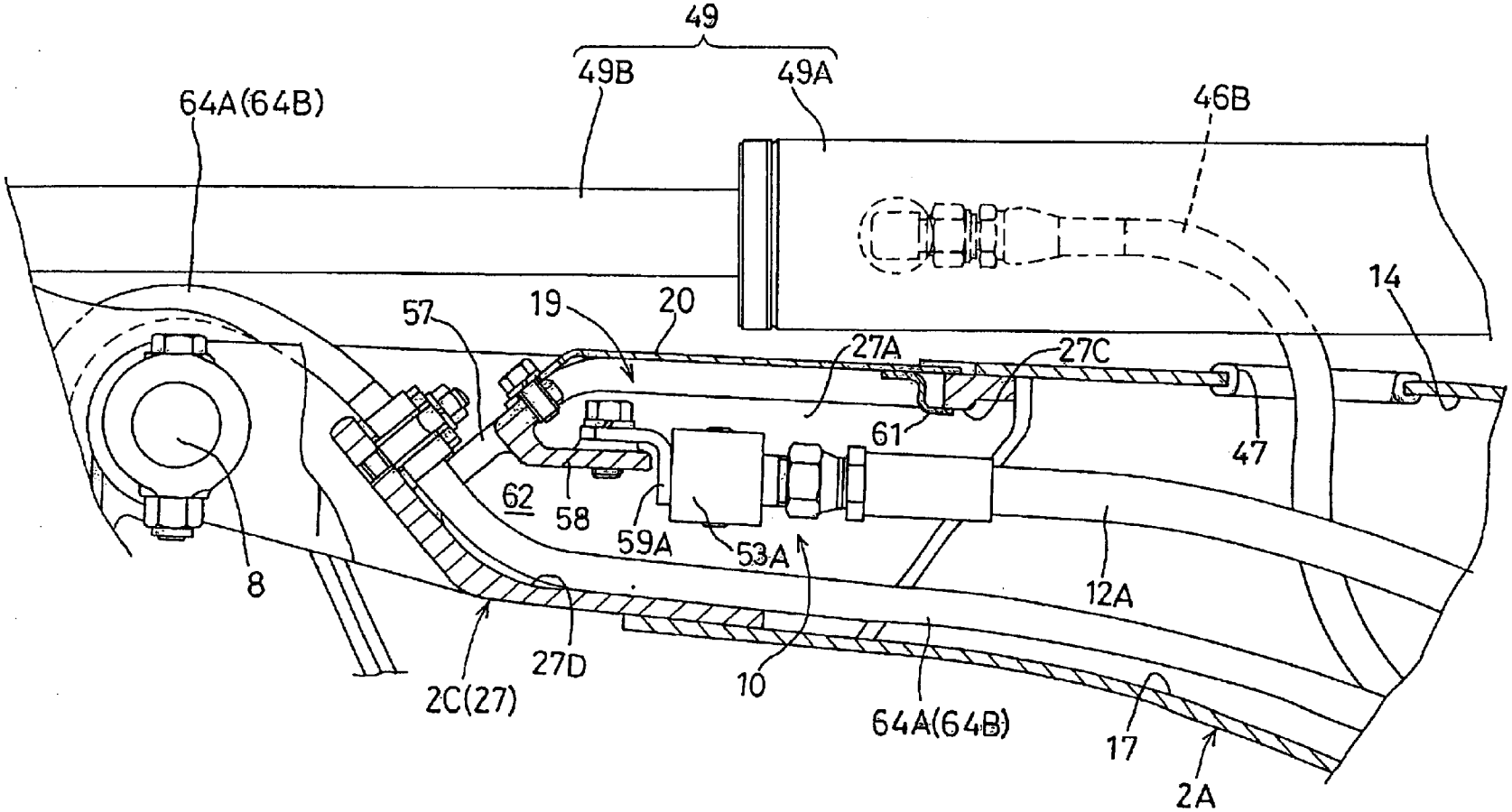
FIG. 4 is a sectional side view of the distal portion of the boom of the backhoe shown in FIG. 1.

As shown in FIG. 3, the hydraulic pressure takeoff device 10 described above has two oil lines, one of which is for pressure oil supply and the other for pressure oil return. That is, pressure oil is supplied from the hydraulic pressure takeoff port 11A or 11B for pressure oil supply to a drive unit (e.g. a hydraulic motor) of the auxiliary working implement, and then returned to the hydraulic pressure takeoff port 11B or 11A for pressure oil return, thereby driving the auxiliary working implement.

In this embodiment, as noted hereinbefore, the hydraulic pressure takeoff ports 11A and 11B are arranged on the right and left side walls 27A and 27B of the distal end member 27, respectively. The hydraulic pressure takeoff hoses 13A and 13B connected to the hydraulic pressure takeoff ports 11A and 11B are spaced from the opposite sides of the boom 2. Consequently, the hydraulic pressure takeoff hoses 13A and 13B, which may be flexible and somewhat long, never become entwined with each other.

The hydraulic pressure takeoff hoses 13A and 13B have the end regions bent through the L-shaped connecting pipes. Thus, the hydraulic pressure takeoff hoses 13A and 13B attached to the hydraulic pressure takeoff ports 11A and 11B may be easily arranged in order.

The space 62 defined below the hydraulic pressure takeoff device 10 accommodates bucket cylinder hydraulic pipes 64A and 64B for supplying hydraulic pressure to the bucket cylinder 63. This arrangement facilitates piping layout, with no need to arrange the hydraulic pipes 64A and 64B to extend around and above the hydraulic pressure takeoff device 10, for example. In addition, the hydraulic pressure takeoff device 10 is not covered by the hydraulic pipes 64A and 64B, which facilitates maintenance of the hydraulic pressure takeoff device 10.

Furthermore, as shown in FIG. 3, an elliptical opening 19 is formed in the rear wall 14 of the boom 2, i.e. the upper wall 27C of the distal end member 27, above the hydraulic pressure takeoff device 10. This opening 19 is substantially the same size as the hydraulic pressure takeoff device 10 in plan view. Through this opening 19 the hydraulic pressure takeoff device 10 may be assembled to the boom 2 easily. In addition, maintenance of the hydraulic pressure takeoff device 10 may be carried out easily.

The distal end member 27 is made by casting or the like as noted hereinbefore, and the opening 19 is not formed by a boring operation or the like. Thus, the rigidity of the distal end member 27 is not lowered by the opening 19. In addition, rigidity may be increased by increasing the wall thickness of portions surrounding the opening 19.

The opening 19 is dosed by a detachable lid 20 slightly larger than the opening. Specifically, the lid 20 has an L-shaped metal fitting 61 attached to a lower surface at one end thereof, and a bore formed at the other end for receiving a fastener such as a bolt or screw.

The boom rear wall 14 defining an edge of the opening 19 fits into a space formed between the lid 20 and L-shaped metal fitting 61. The fastener extending through the bore of the lid 20 is screwed to the partition wall 57. In this way, the lid is fixed to close the opening 19.

With the opening 19 closed by the lid 20, the hydraulic pressure takeoff device 10 is protected from sand, water and dust which could otherwise enter through the opening. The lid 20 is detachable only by removing the fastener to facilitate maintenance of the hydraulic pressure takeoff device 10.

The hydraulic pipes 12A and 12B connected to the hydraulic pressure takeoff device 10 described above are laid to extend from the swivel base 32 into the boom 2 as shown in FIG. 2.

That is, the hydraulic pipes 12A and 12B are connected to a control valve (not shown) mounted in the swivel base 32. Further, the hydraulic pipes 12A and 12B extend out of the swivel base 32 through the flange unit 4 and the hydraulic pipe receiving bore 22 of the swing bracket 5 and over the boom proximal end shaft 6. Then, the hydraulic pipes 12A and 12B enter the boom 2 through the proximal opening 15 formed adjacent the proximal end 2B of the boom rear wall 14, and extend along the front wall 17 of the boom 2 to the hydraulic pressure takeoff device 10. Then, the hydraulic pipes 12A and 12B are screw-connected to the L-shaped connecting pipes 53A and 53B of the hydraulic pressure takeoff device 10.

Since the hydraulic pipes 12A and 12B enter the boom 2 from the proximal end opening 15 in boom 2, only very small portions of the hydraulic pipes 12A and 12B are exposed to the outside. Even adjacent the swing bracket 5, the hydraulic pipes 12A and 12B are enclosed. During operation of the swivel type working vehicle 1, the hydraulic pipes 12A and 12B are free from damage done through contact with other objects.

The hydraulic pipes 43A and 43B for supplying hydraulic pressure to the boom cylinder 3, and the hydraulic pipes 46A and 46B for supplying hydraulic pressure to the arm cylinder 49, are in substantially the same layout as the hydraulic pipes 12A and 12B.

That is, the hydraulic pipes 43 and 46 extend from control valves mounted in the swivel base 32 out through the flange unit 4 and through the hydraulic pipe receiving bore 22 of the swing bracket 5. Then, the hydraulic pipes 43 and 46 extend from the hydraulic pipe receiving bore 22 over the boom proximal end shaft 6, enter the boom 2 through the proximal opening 15, and extend along the front wall 17 of the boom 2.

Thereafter, the hydraulic pipes 43A and 43B extend out through the receiving bores 44 formed in the rear wall 14 below the boom cylinder 3, to be connected to the boom cylinder 3.

The hydraulic pipes 46A and 46B extend out through the receiving bores 47 formed in the rear wall 14 below the boom cylinder 3, to be connected to the arm cylinder 49.

As are the hydraulic pipes 12A and 12B, the hydraulic pipes 43 and 46 laid out in this way are contained in the boom 2 to be protected from damage during operation.

This invention is not limited to the above embodiment, but may be modified in various ways.

For example, the backhoe illustrated is the rear small turn type having the rear end of the swivel base 32 approximately corresponding to outermost ends of the right and left crawlers 29. Instead, the backhoe may be the standard turn type having the rear end of the swivel base 32 protruding from the outermost ends of the right and left crawlers 29. The swivel type working vehicle 1 may be a power shovel.

It is not absolutely necessary to use the L-shaped connecting pipes 53A and 53B for the hydraulic pressure takeoff device 10. Female hydraulic couplers 54A and 54B may be attached to the ends of the hydraulic pipes 12A and 12B to open outside the right and left sides walls 16A and 16B to act as the hydraulic pressure takeoff ports 11A and 11B.

In the foregoing embodiment, the hydraulic pressure takeoff ports 11A and 11B are provided by the female hydraulic couplers 54A and 54B, and the hydraulic pressure takeoff hoses 13A and 13B have male hydraulic couplers 55A and 55B at the ends connected to the female hydraulic couplers 54A and 54B. This male/female relationship may be reversed.

Further, though the hydraulic couplers 54A and 54B are used as the hydraulic pressure takeoff ports 11A and 11B in the foregoing embodiment, threaded tubes with stop valves may be used instead. In this case, the hydraulic pressure takeoff hoses 13A and 13B have threaded ends screwed to the threaded tubes.

What is claimed is:

1. A backhoe comprising:

a running device;

a swivel base mounted on said running device to be swivelable about a vertical swivel axis;

a swing bracket supported to be swingable about a vertical axis by a flange unit disposed at a front end of said swivel base;

a boom having a proximal end thereof attached to said swing bracket to be swingable about a horizontal axis, said boom being a hollow box having a front wall, a left wall, a right wall and a rear wall extending longitudinally of the boom;

a boom cylinder having one end thereof connected to said swing bracket and the other end to said boom for swinging said boom, said boom cylinder being disposed outside said boom to extend along said rear wall of said boom;

a hydraulic pressure takeoff device disposed in a distal end region of said boom; and hydraulic pressure takeoff pipes for supplying hydraulic pressure to said hydraulic pressure takeoff device, said hydraulic pressure takeoff pipes extending from said swivel base through a proximal opening formed adjacent said boom proximal end into said boom to reach said hydraulic pressure takeoff device;

wherein said hydraulic pressure takeoff device is mounted in said boom to form an interior space with said front wall; and wherein bucket cylinder hydraulic pipes connected to a bucket cylinder for swinging a bucket of the backhoe extend from said swivel base through said boom proximal opening and said interior space out of said distal end of said boom to said bucket cylinder.

2. A backhoe as defined in claim 1, wherein said hydraulic pressure takeoff device has hydraulic pressure takeoff ports extending through said boom left wall and said boom right wall, respectively.

3. A backhoe as defined in claim 1, wherein said boom rear wall defines an opening for allowing access to said hydraulic pressure takeoff device, said opening being closable by a lid.

4. A backhoe as defined in claim 1, wherein said swing bracket defines a hydraulic pipe receiving bore communicating with said boom proximal opening, all hydraulic pipes extending from said swivel base extendin into said boom through said hydraulic pipe receiving bore and said boom proximal opening.

5. A backhoe as defined in claim 1, wherein said swing bracket is disposed above said running device, said vertical axis being disposed rearwardly of a front roller axis of front rollers of crawlers constituting said running device.

6. A swivel type working vehicle comprising:

a running device;

a swivel base mounted on said running device to be swivelable about a vertical swivel axis;

a swing bracket supported to be swingable about a vertical axis by a flange unit disposed at a front end of said swivel base;

a boom having a proximal end thereof attached to said swing bracket to be swingable about a horizontal axis, said boom being a hollow box having a front wall, a left wall, a right wall and a rear wall extending longitudinally of the boom;

a boom cylinder having one end thereof connected to said swing bracket and the other end to said boom for swinging said boom, said boom cylinder being disposed outside said boom to extend along said rear wall of said boom;

a hydraulic pressure takeoff device disposed in a distal end region of said boom, wherein said hydraulic pressure takeoff device has hydraulic pressure takeoff ports extending through said boom left wall and said boom right wall, respectively; and hydraulic pressure takeoff pipes for supplying hydraulic pressure to said hydraulic pressure takeoff device, said hydraulic pressure takeoff pipes extending from said swivel base through a proximal opening formed adjacent said proximal end into said boom to reach said hydraulic pressure takeoff device.

7. A swivel type working vehicle as defined in claim 6, wherein said hydraulic pressure takeoff device is mounted in said boom to form an interior space with said front wall; and wherein bucket cylinder hydraulic pipes connected to a bucket cylinder for swinging a bucket of the working vehicle extend from said swivel base through said boom proximal opening and said interior space out of said distal end of the boom to said bucket cylinder.

8. A swivel type working vehicle as defined in claim 6, wherein said boom rear wall defines an opening for allowing access to said hydraulic pressure takeoff device, said opening being closable by a lid.

9. A swivel type working vehicle as defined in claim 6, wherein said swing bracket defines a hydraulic pipe receiving bore communicating with said boom proximal opening, all hydraulic pipes from said swivel base extending into said boom through said hydraulic pipe receiving bore and said boom proximal opening.

10. A swivel type working vehicle as defined in claim 6, wherein said swing bracket is disposed above said running device, said vertical axis being disposed rearwardly of of a front roller axis of front rollers of crawlers constituting said running device.

* * * * *

UNITED STATES PATENT AND TRADEMARK OFFICE

CERTIFICATE OF CORRECTION

PATENT NO. : 6,872,043 B2
DATED : March 29, 2005
INVENTOR(S) : Yukawa et al.

It is certified that error appears in the above-identified patent and that said Letters Patent is hereby corrected as shown below:

Column 9,
Line 42, “swivel base extendin” should read -- swivel base extending --.

Column 10,
Line 49, “rearwardly of of” should read -- rearwardly of --.

Signed and Sealed this

Eleventh Day of October , 2005

JON W. DUDAS
*Director of the United States Patent and Trademark Office*